United States Patent [19]

Perkins

[11] 4,233,952

[45] Nov. 18, 1980

[54] HAND CATAPULT DEVICE

[75] Inventor: John A. Perkins, Portage, Mich.

[73] Assignee: Perky & Me Co., Battle Creek, Mich.

[21] Appl. No.: 891,614

[22] Filed: Mar. 30, 1978

[51] Int. Cl.[3] ..... F41B 3/00

[52] U.S. Cl. ..... 124/5; 124/42

[58] Field of Search ..... 124/5, 4, 41 R, 36, 124/42, 43, 7, 8, 40; 81/126, 417

[56] References Cited

U.S. PATENT DOCUMENTS

| | | | |
|---|---|---|---|
| 889,926 | 6/1908 | Haughawout | 124/8 |
| 917,850 | 4/1909 | Crenshaw | 124/8 |
| 2,122,984 | 7/1938 | Loomis | 124/5 |

*Primary Examiner*—Richard C. Pinkham
*Assistant Examiner*—William R. Browne
*Attorney, Agent, or Firm*—Fisher, Gerhardt, Crampton & Groh

[57] ABSTRACT

A hand catapult for throwing flying discs such as a Frisbee ™ or a Flying Saucer ™ is constructed with a yoke pivotally connected to a handle for a movement through an angle of not more than about 45 degrees to each side of the center line of the device. The yoke comprises an inner circumferentially channeled semicircular portion conforming to and adapted to receive the disc and having a long complementarily channeled arm projecting tangentially from one terminus of the semicircular portion and a short complementarily channeled arm projecting from the other terminus of the semicircular portion. The yoke is constructed of semirigid plastic material and the short arm extends beyond the semicircular portion a distance just sufficient to offer a slight resistance to the insertion and withdrawal of the disc in the channeled semicircular portion. The device is biased to the uncocked position and is provided with a pressure-releasable device for holding the yoke in the cocked position against said bias device. The pressure-releasable device is adjusted to be released by the pressure engendered thereon by the tendency of the yoke to rotate toward the uncocked position when it is swung in an arc by the person grasping the handle.

10 Claims, 7 Drawing Figures

HAND CATAPULT DEVICE

BACKGROUND OF THE INVENTION

1. Field of Invention

The invention relates to hand catapults for throwing flying discs such as a Frisbee TM or a Flying Saucer TM, clay pigeons, and the like.

2. PRIOR ART

Various devices are known in the art for throwing clay pigeons and are commonly termed hand traps. See, for example, U.S. Pat. Nos. 1,186,098, 1,700,880, 1,865,173, 2,122,984 3,537,348, and 3,901,208. Other catapults for throwing discs and other shapes are found in U.S. Pat. Nos. 2,493,245 and 3,373,730.

None of the prior art devices, however, are suitable for the hand throwing of flying discs such as Frisbees and Flying Saucers.

OBJECTS OF THE INVENTION

It is the object of the invention to provide an improved hand catapult device for throwing flying discs. It is a further object of the invention to provide such a hand catapult device which is economical to manufacture and which is effective for its intended purpose. It is a further object of the invention to provide such a hand catapult device which is effective for throwing flying discs such as Frisbees and Flying Saucers. It is a further object of the invention to avoid the disadvantages of the prior art and to obtain such advantages as will appear as the description proceeds.

BRIEF DESCRIPTION OF THE INVENTION

The invention relates to a hand catapult for throwing flying discs comprising a yoke constructed of semirigid plastic material pivotally connected to a handle for movement through an angle of not more than about 45 degrees to each side of the center line of the device, in which the yoke comprises an inner circumferentially channeled semicircular portion conforming to and adapted to receive the disc and having a long complementarily channeled arm projecting tangentially from one terminus of the semicircular portion and a short complementarily channeled arm projecting circumferentially from the other terminus of the semicircular portion a distance just sufficient to offer a slight resistance to the insertion and withdrawal of a disc into the channeled semicircular portion and further comprising biasing means for biasing the yoke to the short-arm side of the center line and in the uncocked position and pressure-releasable means for holding the yoke in the long-arm side of the center line and the cocked position, which pressure-releasable means is adjusted to be released by the pressure engendered thereon by the tendency of the yoke to rotate toward the uncocked position when it is swung in an arc by a person grasping the handle.

Advantageously, the biasing means comprises an elastic band, one end of which is anchored to the handle and the other end of which is anchored to the short-arm side of the yoke. More particularly, it is directed to such a device in which the elastic band is a continuous band having looped ends which are anchored in slots angled into the handle and the yoke at an angle such that the entrances to the slots are spaced farther away from each other than the inner portions thereof, whereby the elastic band does not slip out either in the uncocked position or in the cocked position.

Advantageously, the slot has a dogleg shape so disposed that when the yoke is in the center line position, that is, midway between the cocked and the uncocked position, the portion of the slot engaged by the elastic band is normal to the axis of the band. This permits the use of a flat wide band without the looped ends rolling over when the yoke is swung from the uncocked position to the cocked position and back.

Advantageously, the pressure-releasable means comprises complementary male and female bosses, one located in the handle and the other located in the yoke. Preferably, the female boss is a hole located in the handle and the male boss is located in the yoke to engage the female boss when the device is cocked. In such case, it is also desirable to provide the handle with an arcuate hole of the same circumference relative to the pivot point as the female boss, which arcuate hole extends from adjacent the female boss at least to the position occupied by the male boss in the uncocked position. This eliminates the drag which otherwise would occur when the male boss is disengaged from the female boss.

In accordance with another form of the invention, the pressure-releasable means comprises a dead-center or past dead-center arrangement for the elastic band when the catapult is cocked. How much pressure will be required to release this type of releasable means depends upon whether the elastic band is precisely on dead-center or past dead-center. The farther it is past dead-center, the greater will be pressure required to accomplish the release.

DETAILED DESCRIPTION OF THE INVENTION

Figure 1:
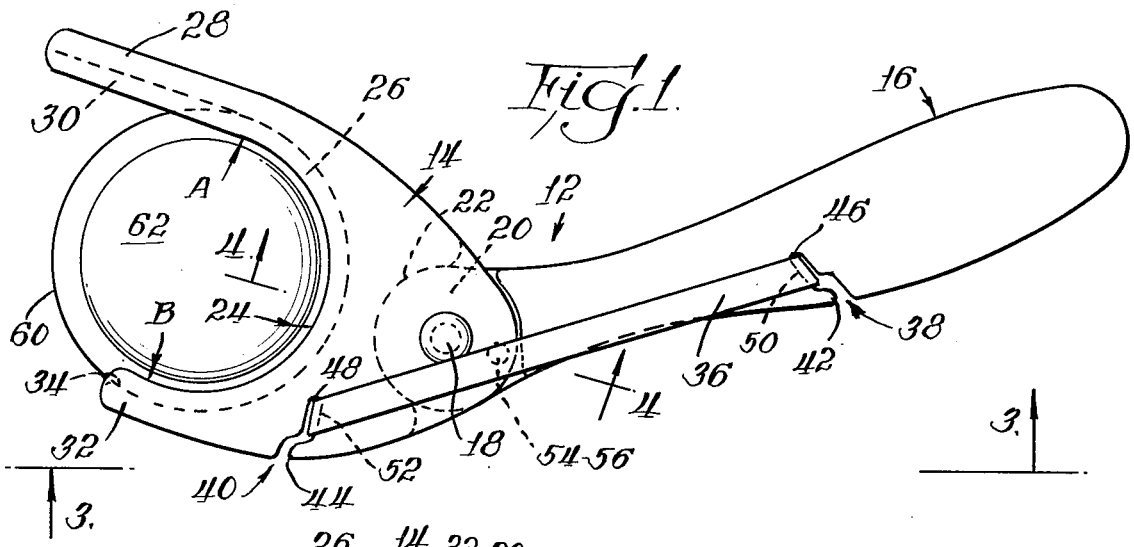
FIG. 1 is a plan view of the catapult device of the invention in the cocked position.

Referring now more particularly to the modification shown in FIGS. 1 through 5, there is shown a hand catapult device 12 comprising a yoke 14 and a handle 16 pivotally connected by the pivot 18. The handle is provided with a tenon 20 which is inserted into the mortise 22 and pivotally fastened therein by the pivot pin 18. The mortise 22 and tenon are complementarily shaped so as to limit the rotation about the pivot to not more than about 45 degrees to each side of the center line projecing up centrally through the handle and through the pivot 18.

The yoke 14 has a semicircular portion 24 having an inner circumferential channel 26. The semicircular portion 24 has the zero degree terminus at A and the 180 degree terminus at B. The diameter from A to B, when the yoke is in the center line position, is normal to the center line.

Projecting from the zero point A is a long arm 28 having a channel 30 which is complementary with the channel 26 of the semicircular portion 24. The arm 28 projects tangentially from terminus A. A short arm 32 projects circumferentially from the 180 degree terminus B and is provided with a channel 34 which is complementary with the channel 26 of the semi-circular portion 24. The arm 32 extends beyond the 180 degree terminus B just sufficient to engender resistance when a disc is inserted in or pulled out of the semicircular portion 24.

Figure 2:
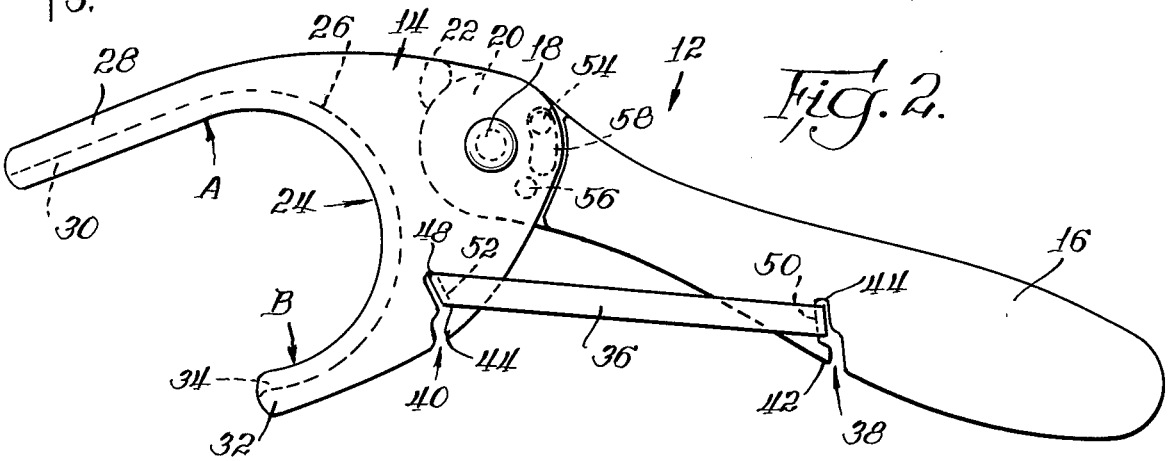
FIG. 2 is a plan view of the device of FIG. 1 in the uncocked position.
Figure 3:
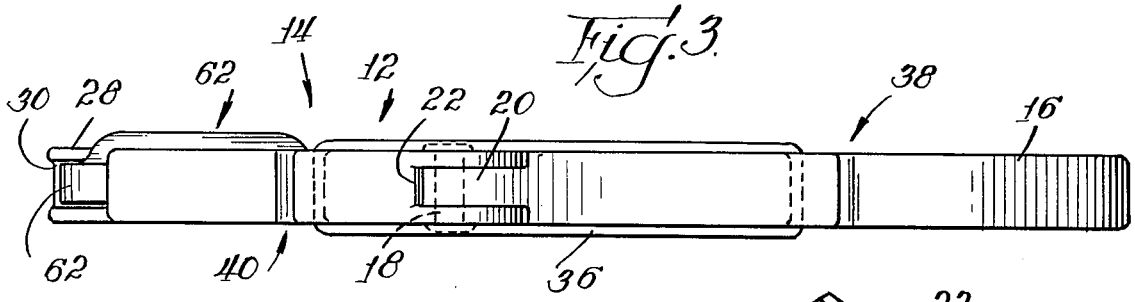
FIG. 3 is a view taken along line 3—3 of FIG. 1.
Figure 4:
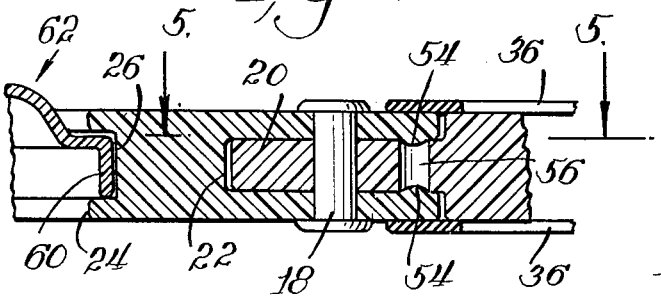
FIG. 4 is a partial view in partial section taken along line 4—4 of FIG. 1.
Figure 5:
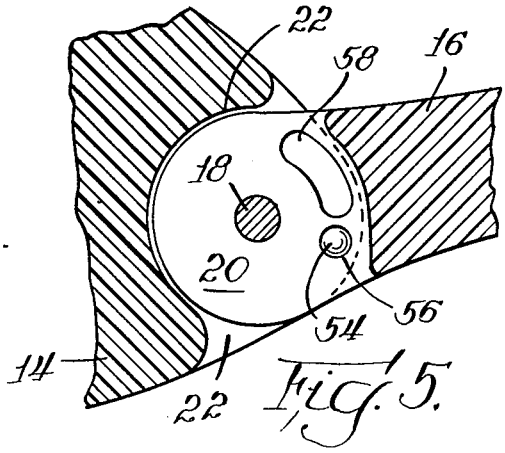
FIG. 5 is a partial view in partial section taken along lint 5—5 of FIG. 4.

The device is biased to the uncocked position of FIG. 2 by an elastic band 36. The elastic band 36 is a continuous band having looped ends which are anchored in slots 38 and 40 located, respectively, in the handle 16 and the yoke 14. The slots 38 and 40 slope in at an angle such that the distance between the inner edge 42 of slot 38 and the inner edge 44 of slot 40 is greater than the distance between the inner portion 46 of slot 38 and the inner portion 48 of slot 40. This keeps the rubber band firmly in the slots both in the uncocked position of FIG. 2 and the cocked position of FIG. 1.

The slots 38 and 40 are doglegged in shape and the inner portion or shank portion 50 or 52 is flat at least the width of the band 36 and is so oriented that when the yoke is in the center line position, the flat portions 50 and 52 are normal to the center line of the band 36. Thus, the yoke can be rotated from the uncocked position of FIG. 2 to the cocked position of FIG. 3, without placing the portions of the band engaging the flat portions 50 and 52 under such an angle as would cause them to roll.

The mortise and tenon 20–22 is provided with complementary male and female bosses. Male bosses are shown at 54 and the female boss is a hole or bore 56, extending through the tenon 20. In the positions shown in FIGS. 1 and 4, the yoke is held in the cocked position by the male boss 54 engaging the female boss 56.

On the tenon 20 on the same radius, with respect to the center of the pivot 18, is an arcuate slot 58, which extends from adjacent to the female boss 56 to the position occupied by the male boss 54 in FIG. 2. Thus, when the male boss 54 disengages the female boss 56, it flips over into the arcuate slot 58 and the yoke is then free to rotate from the position of release to the position shown in FIG. 2.

Figure 6:
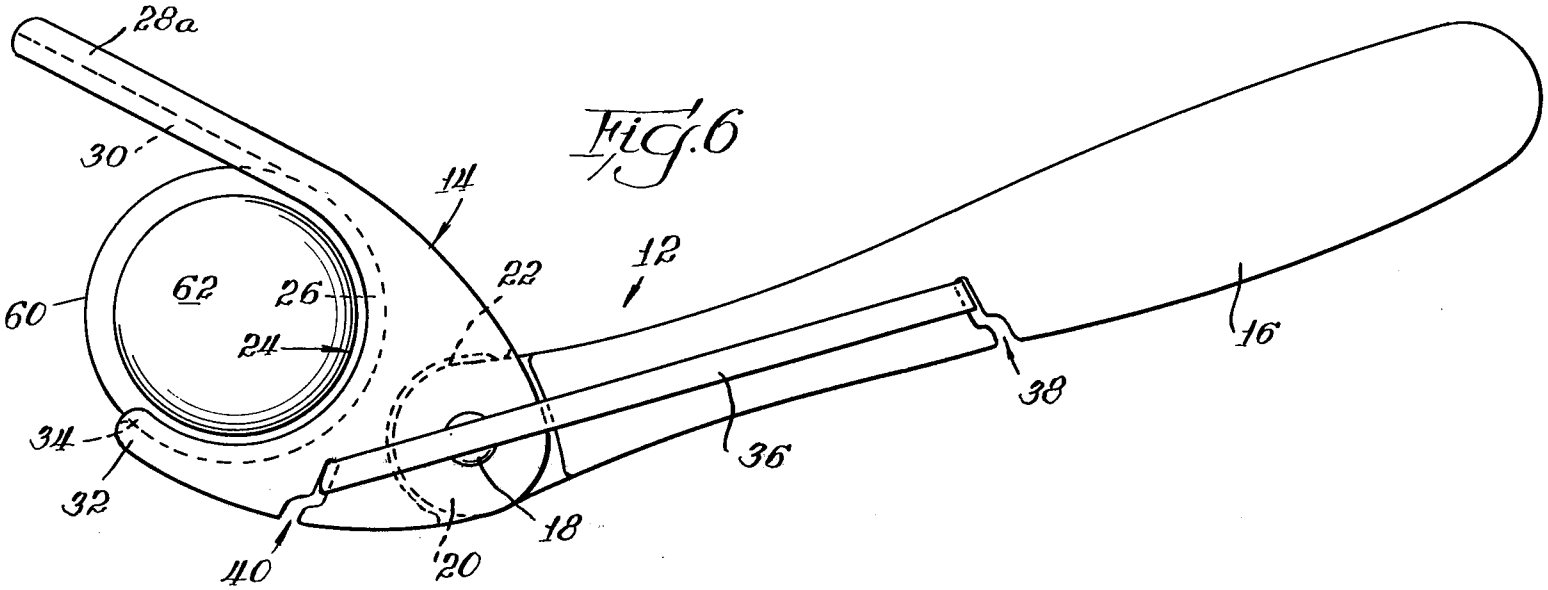
FIG. 6 is a plan view of a modified form of the invention in the cocked position.
Figure 7:
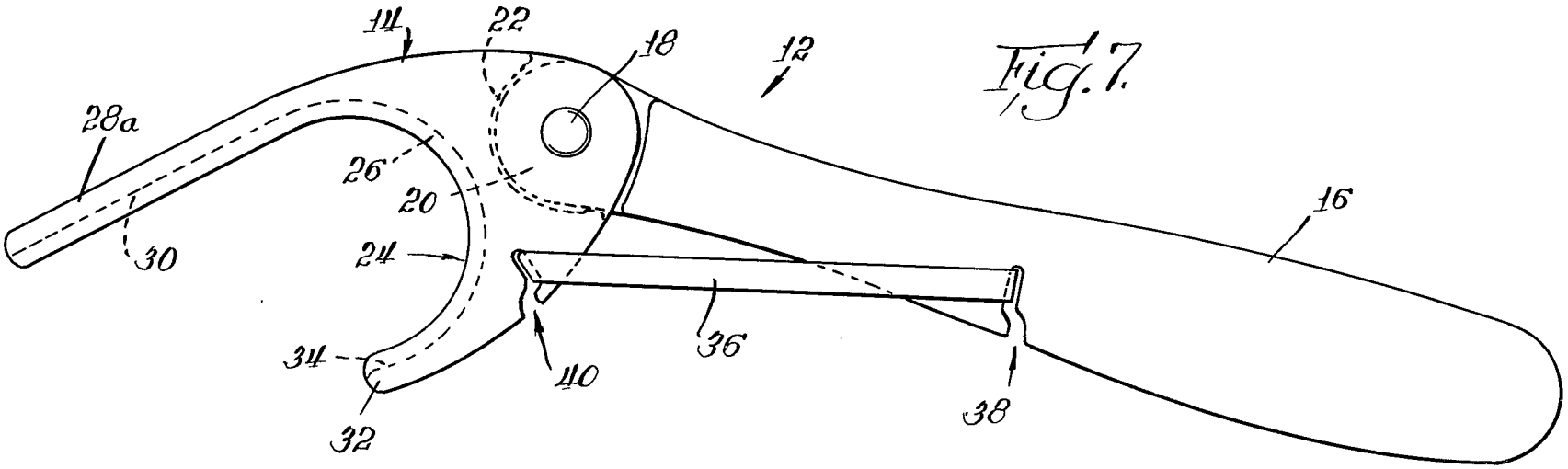
FIG. 7 is a plan view of FIG. 6 in the uncocked position.

In the construction shown in FIGS. 6 and 7, the yoke and the handle are pivoted together in essentially the same manner as in the other modification, but are not provided with the male and female bosses. Instead, the mortise 22 is undercut a little more on the cocked side in order to allow the elastic band 36 to rotate to or slightly past dead-center. Also, the long arm 28*a* is made slightly longer than the long arm 28. This is for the purpose of imparting a greater rolling action to the disc.

In operation, the flying disc such as a Frisbee or a Flying Saucer is inserted into the semicircular portion 24, the device is cocked to the position shown in FIGS. 1 and 6, either before or after the insertion, the handle 16 is grasped and the device is swung in an arc in a counter clockwise direction until the releasable means is released, then the yoke is swung past the center line position toward the position shown in FIG. 2. In this movement, the flying disc is disengaged from short arm 38 and rolls along in the channel on the long arm 28 which causes the flying disc to spin or roll as it is catapulted from the device. The channels 26, 30, and 34, advantageously, are dimensioned to give a close but not tight fit to the rim 60 of the flying disc 62.

It is understood that the invention is not to be limited to the exact details of operation or structure shown and described, as obvious modifications and equivalents will be apparent to one skilled in the art.

I claim:

1. A hand catapult device for throwing a flying disc which comprises a yoke constructed of semirigid plastic material pivotally connected to a handle for movement through an angle of not more than about 45 degrees to each side of the longitudinal center line of said handle, said yoke comprising an inner circumferentially channeled, semicircular portion conforming to and adapted to receive said disc and having a long complementarily channeled arm projecting tangentially from one terminus of said semicircular portion and a short complementarily channeled arm projecting circumferentially from the other terminus of said semicircular portion and being stationary relative to said long arm, said short arm projecting a distance just sufficient to offer resistance to the insertion and withdrawal of a disc in the channeled semicircular portion, biasing means for biasing said yoke to the short-arm side of the center line in the uncocked position, and pressure-releasable means for holding said yoke in a position whereby the yoke is on the other side of the long-arm side of the center line in the cocked position, said pressure releasable means being adjusted to be released by the pressure engendered thereon by the tendency of said yoke to rotate from the cocked toward the uncocked position when it is swung in an arc by a person grasping said handle.

2. The hand catapult device of claim 1, in which said biasing means comprises an elastic band, one end of which is anchored to said handle and the other end of which is anchored to the short-arm side of said yoke.

3. The hand catapult device of claim 2, in which said elastic band is a continuous band having looped ends which are anchored in slots angled into the handle and the yoke at an angle such that the entrances to the slots are spaced farther away from each other than the inner portions thereof, whereby the elastic band does not slip out either in the uncocked position or in the cocked position.

4. The hand catapult device of claim 3, in which the slot has a dogleg shape so disposed that when the yoke is in a center line position, the portion of the slot engaged by said elastic band is normal to the axis of said band.

5. The hand catapult device of claim 1, in which said pressure-releasable means comprises complementary male and female bosses.

6. The hand catapult device of claim 5, in which the female boss comprises a hole located in the handle and the male boss is located in the yoke in a position to engage said female boss when the catapult is cocked.

7. The hand catapult device of claim 1, in which said pressure-releasable means comprises complementary male and female bosses, one of which is located in the yoke and the other of which is located in the handle.

8. The hand catapult device of claim 7, in which the female boss comprises a hole and the male boss is located in a position to engage said female boss when the catapult is cocked.

9. The hand catapult device of claim 8, in which an arcuate hole is disposed on the same radius relative to the pivot connection as said female boss, said arcuate hole extending from adjacent to said female boss at least to the position occupied by said mail boss in the uncocked position.

10. A hand catapult device for throwing a flying disc which comprises a yoke constructed of semirigid plastic material pivotally connected to a handle for movement through an angle of not more than about 45 degrees to each side of the center line of said handle, said yoke comprising an inner circumferentially channeled, semicircular portion conforming to and adapted to receive said disc and having a long complementarily channeled arm projecting tangentially from one terminus of said semicircular portion and a short complementarily channeled arm projecting circumferentially from the other terminus of said semicircular portion a distance just sufficient to offer resistance to the insertion and withdrawal of said disc in the channeled semicircular portion, biasing means for biasing said yoke to the uncocked position at the short-arm side of the center line, and pressure releasable means for holding said yolk in a position whereby the cocked position at the long-arm side of the yoke is on the other side of the center line, said pressure releasable means being adjusted to be released by the pressure engendered thereon by the tendency of said yoke to rotate toward the uncocked position when it is swung in an arc by a person grasping said handle, a female boss comprising a hole located in the handle and a male boss being located in the yoke in a position to engage said female boss when the catapult is cocked, said handle having an arcuate hole therein of the same circumference relative to the pivot connection as said female boss, said arcuate hole extending from adjacent to said female boss at least to the position occupied by said male boss in the uncocked position.

* * * * *